US005191907A

United States Patent [19]

Hirzel

[11] Patent Number: 5,191,907

[45] Date of Patent: Mar. 9, 1993

[54] CURLING DEVICE HEAD WITH A HOLDING ELEMENT

[76] Inventor: Suzy C. Hirzel, 933 Shellwood Way, Sacramento, Calif. 95831

[21] Appl. No.: 747,704

[22] Filed: Aug. 20, 1991

[51] Int. Cl.[5] ..... A45D 24/30

[52] U.S. Cl. ..... 132/107; 132/118; 132/126; 132/148; 132/161

[58] Field of Search ..... 132/107, 118, 122, 126, 132/137, 138, 148, 161, 219, 229, 233, 269

[56] References Cited

U.S. PATENT DOCUMENTS

| | | | |
|---|---|---|---|
| D. 203,736 | 2/1966 | Giannola | 132/107 |
| 2,272,942 | 2/1942 | Goodwin | 132/107 |
| 2,609,822 | 9/1952 | McCormack et al. | 132/107 |
| 3,083,715 | 4/1963 | Trabish | 132/107 |
| 3,820,551 | 6/1974 | Lanzillotta | 132/229 |

FOREIGN PATENT DOCUMENTS

| | | | |
|---|---|---|---|
| 633291 | 12/1949 | United Kingdom | 132/122 |

*Primary Examiner*—Gene Mancene
*Assistant Examiner*—Frank A. LaViola

[57] ABSTRACT

An improved curling device is comprised of a horizontal, generally round base, having elongated main teeth vertically extending from around the edge of the base, interior of the base having one or more row(s) of smaller additional teeth, which are tightly spaced to sufficiently brush, tease and grab the hair. The outer row of teeth being tapered outwardly from a vertical plane as the outer teeth extend from the lower teeth ends to upper teeth tips. The bottom of the base is attached to the vertical holding element.

12 Claims, 4 Drawing Sheets

CURLING DEVICE HEAD WITH A HOLDING ELEMENT

BACKGROUND OF INVENTION

The present invention relates to a hair grooming device with improved teeth position and structure, and incorporating various handles.

PRIOR ART

Most people use a round brush when they blow dry and curl their hair. However, since the bristles on existing round brushes point horizontally it is necessary to unwind the brush to remove the brush from the hair. This procedure often causes tangling, pulling, and snarling.

Many non-tangling curling brushes with vertical teeth were invented in the past. British Patent Number 633,291 by L. Lewis; U.S. Pat. No. 2,272,942 by P. J. Goodwin, Jan. 21, 1941; U.S. Pat. No. 2,609,822 by Mc Cormack and so many others. However, they did not disclose teeth position or structure of the teeth.

One of the essential elements of the curling, picking brush is the length of the teeth. The teeth should be least 1¾" to 3½" long, therefore length cannot be shortened. Applicant found out, through many months of testing, that if teeth are longer than 1½" and made by plastic injection molding, the cooling process alters the intended teeth position which is bent/slanted inward, also causing teeth to break and leaving a rough surface, while leaving melted plastic resin inside of the teeth-tip portion of the mold. Applicant also discovered that quality of the materials used in injection molding is extremely important.

Another important factor of the curling device structure is spaces between the teeth near the base. It is important to be tight enough at the bottom to grab the hair, brush, and tease the hair. However, the space between the upper teeth tip to tip should be wider for easy insertion.

An ideal curling device should be a combination of a: 1) pick (lifter); 2) teaser (back combing); 3) separator; 4) brush.

Another important element is that the handle size should be substantial and generally rounded with vertical serration. This method will prevent fingers/hand from slipping while rotating the handle.

The device/brush teeth length should be varied and alternated to make the space between the teeth tips widest at the upper portion of the brush. This will make it easier to insert the teeth to the hair. The distance between the teeth near the base should be narrowest, which is more effective when grabbing/brushing/teasing the hair.

When teeth are tapered inward, it will cause several predicted adverse results which are listed below:

a) cannot be used effectively as a pick or lifter,
b) slow and difficult insertion,
c) does not grab a sufficient amount of hair,
d) hair keeps slipping out from brush teeth when rotating the brush,
e) poor teasing.

To eliminate the warped inward teeth, mold teeth cavity has to be slanted (angled) outward. The tip of the teeth in the mold teeth cavity should be slanted outward at from the center line of the teeth near the base. However, the teeth slant should not be excessive enough to damage the mold.

It would also be beneficial if the heating element is incorporated with the curling device to dry the hair while curling the hair. This method will free one of the hands to apply the curling spray to speed up the curling. Since hot air will be blowing in the same general direction as the teeth (vertically), it will heat the hair and not the scalp. This method will dry and curl the hair rapidly.

Tony Lanzillotta invented Hair dryer and Groomer, U.S. Pat. No. 3,820,551, issued date, Jun. 28, 1974. This invention incorporated with dry and curling device. However, his invention does not have outward tapered teeth, and electric cord is located on the side of the handle. The electric cord should be located center of the handle end, and, also, it should be rotatable cord, so, even when the handle rotates during curling process, the cord should remain in same position, other wise, the cord will be tangled and twisted. Lansillotta's invention does not disclose rotatable cord, even if he did disclosed, with side located cord would not function.

There remains a need for an improved apparatus which allows it to be used as a curler, pick, brush and blow-dryer combination.

The apparatus should be simple, durable, inexpensive and efficient in performing the above described functions.

SUMMARY OF THE INVENTION

The improved curling device of the present invention satisfies all of the foregoing needs. The device is substantially set forth in the abstract. Improved curling device, which is constructed with teeth elements vertically, and extending from around the edge of the horizontal stationary base, which is the outer teeth. The teeth are long enough to lift, section hair, and create spiral curls on the teeth of this device. The base can be generally: round, square, rectangular, triangular, oval or any other shape. In this case applicant will describe round shaped base. However, triangular, rectangular and square base will create interesting curl-shaped hair styles and rectangular shape brush can be used for cutting guide. The diameter of the combined teeth position of the device determines the size of the curls. Therefore, the diameter of the combined teeth position of the device varies from approximately 14 mm to 60 mm. Individual outer teeth diameters near the base are approximately 2 mm to 5 mm and tips are 1.1 mm to 2.5 mm. The teeth are thicker near the base and thinner toward the tip (tapered) for easy insertion to hair and easy removal from injection mold cavities. The shape of the teeth maybe round, square, rectangular, triangular or any other shape. In this case applicant will use a generally round shape as an example.

Beside the row of outer teeth, the base may have a single row or more of inner teeth. The row of inner teeth are shorter and thinner than the row of outer teeth. The inner teeth are spaced closer together than the outer teeth. The narrow spacing will be more effective for brushing, teasing, and also securing the hair while in the rolling process. Space between individual inner teeth should never be more than 3 mm. However, the spacing between the outer teeth may be up to 6 mm. Both outer and inner teeth may be of various lengths for easy insertion and teasing effect. Outer teeth and inner teeth cooperate to increase overall rolling, brushing, grasping and teasing abilities of the brush.

The surface of all teeth tips should be smooth for easy insertion. The surface of all teeth near the base may be textured to secure the hair for rolling and/or teasing. The teeth tips may be covered with plastic, ceramic, or other materials to make them extra smooth.

In the present invention, the nylon material used is not only heat resistant at temperatures up to 325 degrees, but it also is ideal for injection molding of long teeth. It prevents the teeth from warping when used with extreme heat from blowdryers and prevents teeth-tips from breaking off inside of the mold. The device can be made of 100% nylon, however, it can be made of combination of other plastic materials.

The entire device (base, teeth, and handle) are made by plastic injection molding in one piece, however, it can be comprised of the base and teeth being injection molded in one piece and any type of existing handle element, such as: comb, brush, pick, hot iron rod, hair styling agent with dispenser, hair blow dryer, or handle with pointed separator. The handle may be constructed of wood, hard rubber, plastic, or metal.

Also, material should have some flexibility, since teeth are slanted outward and molds are rigid (steel), some flexibility is necessary to prevent the shortening of the life of the mold.

The present invention can also be made of metal, especially heat conducting material in one piece. However, applicant prefers teeth and base to ideally be made of metal (especially aluminum), meanwhile the handle will be made of a non-heat conducting material. The metal utilized in the present invention will be best suited to be heated by electricity, butane, oven heating, battery, or any heating element. The various heating elements mentioned would be able to transfer heat to the teeth. The teeth tips may be covered with a heat insulating material to prevent burning the skin during the use.

DETAILED DESCRIPTION

FIGS.: 1, 2, 3, and 4

Figure 1:
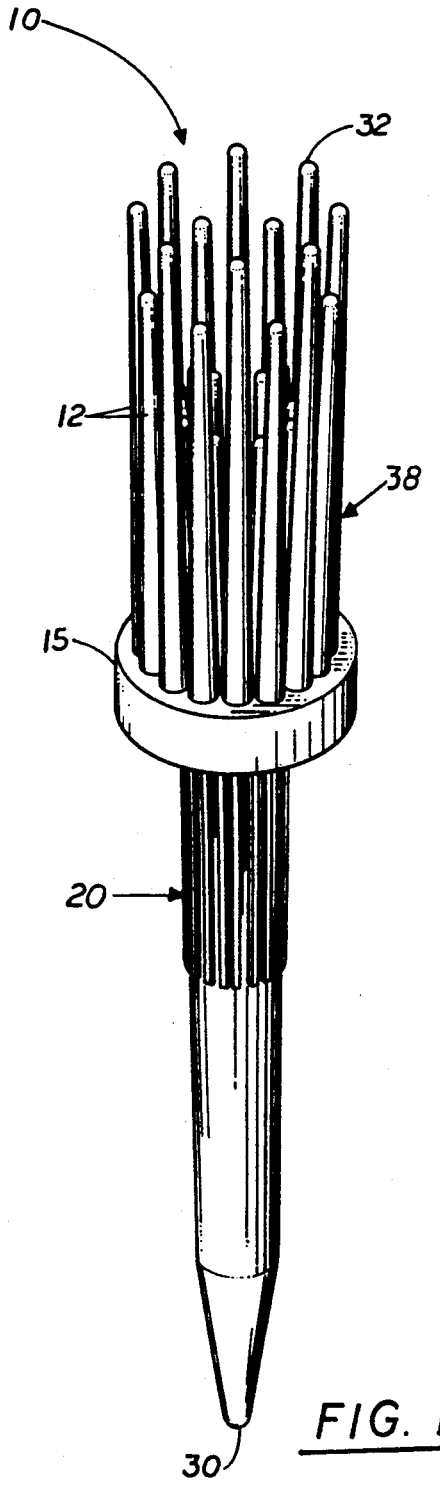
FIG. 1 is a perspective side view of the first embodiment of the improved curling device.
Figure 2:
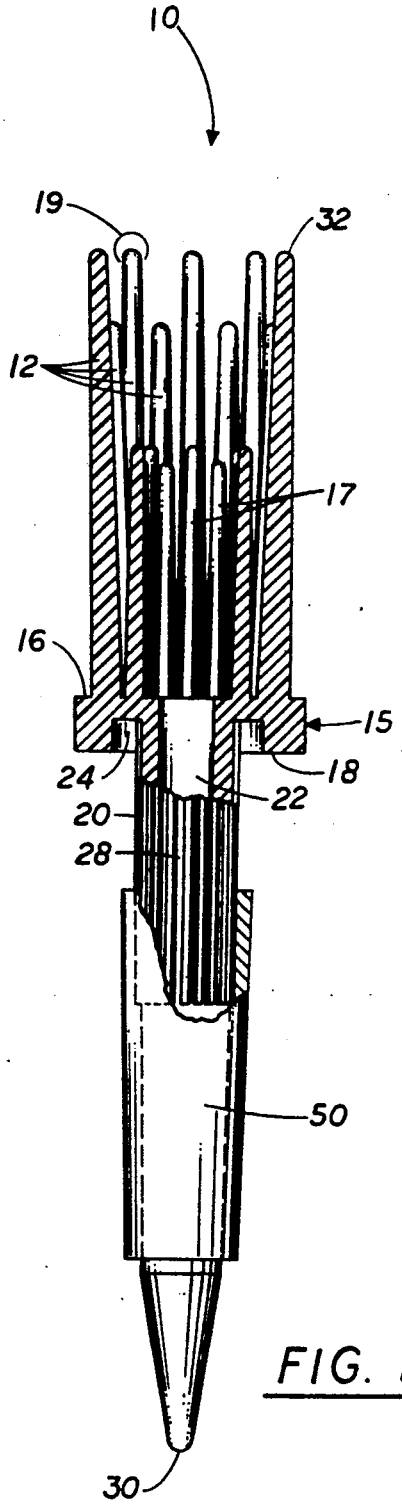
FIG. 2 is a cross-section of the side view of the first embodiment of the improved curling device.

Referring more particularly to FIGS. 1, 2, 3, and 4, the embodiment of the improved curling device of the present invention is schematically depicted. The improved curling device 10, which is comprised of brush head 38 and holding element 20. The brush head 38 is comprised of a horizontal round base 15, having vertical outer teeth 12, extending from top panel 16, around the border of the base 15 (FIGS. 1 and 2).

Figure 3:
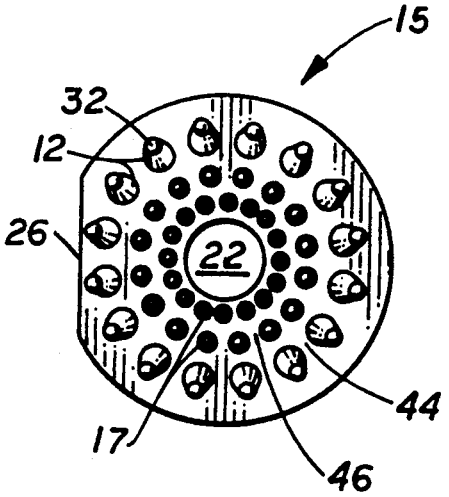
FIG. 3 is a top view of the first embodiment of the improved curling device.

The outer row of teeth 12, are at least 4 cm to 9 cm long. The outer row of teeth 12 being tapered outwardly from a vertical plane from the bottom of the outer teeth ends to the upper teeth tips 32 (FIG. 3). Inner teeth 17, are shorter than outer teeth 12. Inner teeth 17, performs many functions, such as brushing, gripping, and teasing the hair. The shorter teeth may be located within the perimeter of the outer row of teeth 12. All teeth 12 and 17, are thicker near the base (bottom), and thinner near the tip (upper). This method will create tighter spacing between the teeth near the base. Also, it will make the injection molding easier.

The lower part of teeth 12 diameter is 3 mm to 6 mm and teeth 17 is approximately 2 mm to 5 mm. Teeth 17 and 12 may have varied lengths and smooth rounded tips for easy insertion. However, lower part of teeth 17 and 12 may have textured surface for better teasing and gripping of the hair (not shown). Teeth tips may have ceramic, rubber, or plastic cover 19 for extra smoothness (FIG. 2).

Space 44 between the outer teeth is wider than space 46 between the inner teeth (FIG. 3).

Lower panel 18 of base 15 is attached to vertical handle 20. Handle 20 may be comprised of wood, hard rubber, metal, or plastic. Plastic or metal handles can be molded in one piece with base 15, teeth 12, and teeth 17 (FIG. 1). Handle 20 may have rubber, plastic, or wood covering 50 for better gripping (FIG. 2).

Base 15 center having hole 22. The center hole 22 has many duties:

1. Let the hot air pass through,
2. Control the shrinkage problem when device is injection molded,
3. Locking element to secure the handle.

During the plastic injection molding process, any plastic piece, which is more than 4 mm thick, experienced a disfiguration/shrinkage problem. The base thickness should be at least 6 mm for rigidness. To insure this, the lower panel 18 having a hollow ring 24 was included to solve the shrinkage problems. Hollow ring 24 may function as locking element when a larger handle is incorporated, such as in the built-in dispenser or blow-dryer embodiments.

Figure 4:
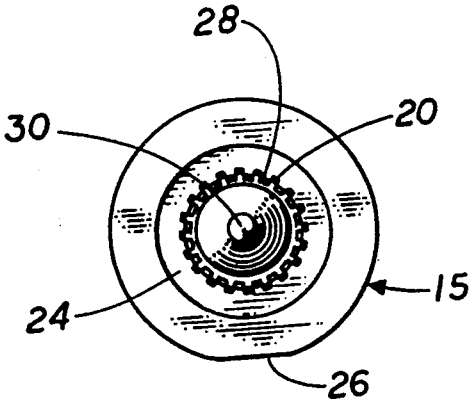
FIG. 4 is a back view of the first embodiment of the improved curling device.

Base 15 having a flat surface that acts as a stopping element 26 (FIG. 3 and 4). This stopping element will help prevent the device from rolling off of any table or flat surface when device is resting horizontally. Also, when device is packaged, the device will stay in one position, which makes it easier to package and allows for the company's logo or slogan to appear clearly.

Handle 20 having vertical serration or grooves 28 at the upper part of the handle, these serration will prevent hand from slipping while rotating the device during the hair curling process (FIG. 2). Also, handle 20 may have a hair separator 30 at the end of the handle.

Figure 5:
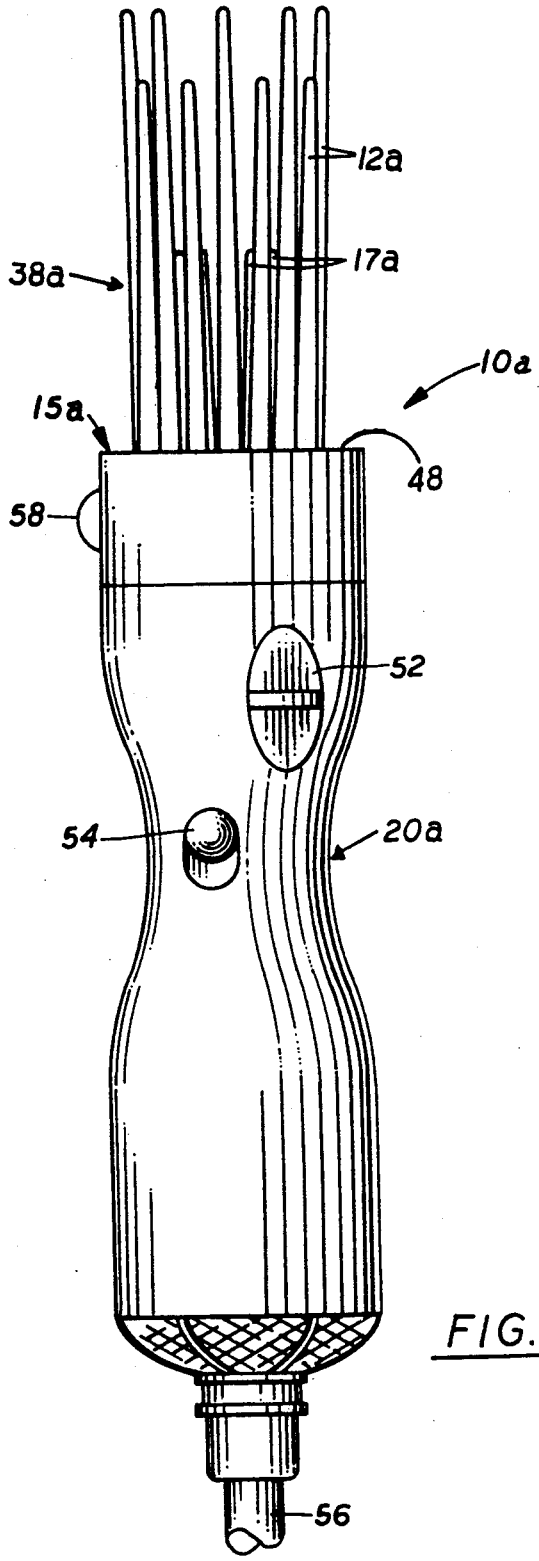
FIG. 5 is a side of the second embodiment of the improved curling device with built-in heating element handle.
Figure 6:
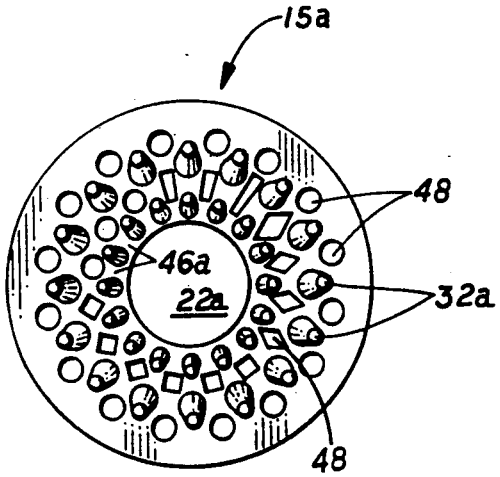
FIG. 6 is a top view of the second embodiment of the improved curling device.

FIGS. 5 and 6

A second preferred embodiment of the improved curling device is schematically depicted in FIGS. 5 and 6. The improved curling device 10*a* is shown. Device 10*a* is similar to device 10 and bear the same numerals but are succeeded by the letter "a". Device 10*a* is identical to device 10 except as follows:

a) Handle 20*a* is comprised of a blowdrying element;
b) Blowdrying ducts 48, which are located in the base 15*a* and could be positioned around and/or between the teeth. This method will allow the hot air from the blowdryer to flow through the blowdrying ducts 48 to dry the hair during the curling process.

c) Handle 20*a*, having a heating element such as electric, butane, or battery. Handle 20*a* can be blowdryer or hot iron handle. The handle 20*a* is connected to base 15*a*. Also, handle 20*a* can be interchangeable with various sizes and styles of brush head 38. Base 15*a* and handle 20*a* may have locking element 58 to secure handle to base 15*a*.

d) Handle 20*a* having On/Off switch 52 and a temperature controlling button 54. Also having a rotatable electric cord 56 at the center of the bottom of the holding element 20*a*. This is necessary to prevent the electrical cord from becoming tangles knotted, or frayed when using during the curling process.

FIG. 7

Figure 7:
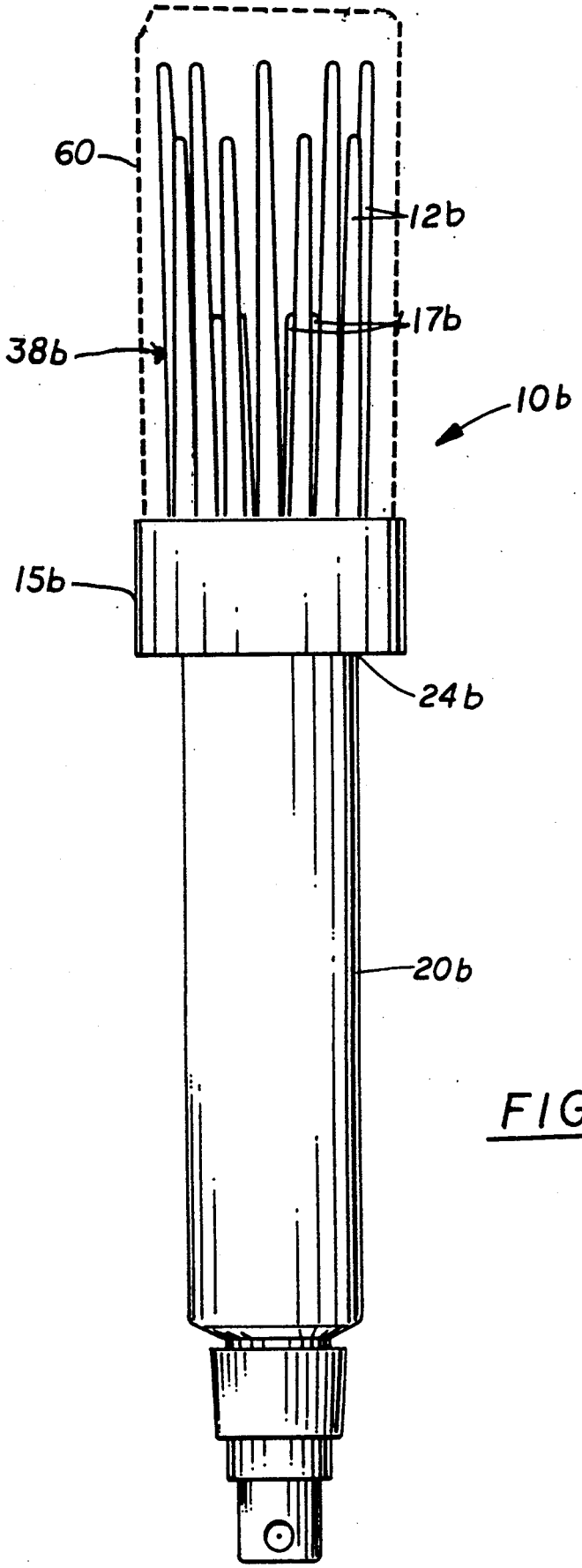
FIG. 7 is a side view of the third embodiment of the improved curling device with built-in spray mist styling agent dispenser handle.

A third preferred embodiment of the improved curling device is schematically depicted in FIG. 7. The improved curling device 10*b* is shown. Device 10*b* is similar to device 10 and 10*a* and bear the same numerals but are succeeded by the letter "b". Device 10*b* is identical to device 10 and 10*a* except that handle 20*b* is a pump spray dispenser. The dispenser can contain the hair styling agent, such as sculpting, styling mist, or spray.

Device 10*b* may have a cap 60 to protect the brush head 38*a*.

Various modifications, changes, alterations and additions can be made in the improved brush of the present invention, its components and their parameters. All such modifications, changes, alterations and additions as are within the scope of the appended claims form part of the present invention.

What is claimed is:

1. A hair curling, picking, and brushing device comprising:

a horizontal base having an upper panel and lower panel, a vertical holding element extending perpendicular to and away from said lower panel;

an outer row of teeth and at least one row of inner teeth extending away from said upper panel, said at least one row of inner teeth being of shorter length than the outer row of teeth and located within the perimeter of said outer row of teeth, said outer row of teeth having upper teeth tips and lower teeth ends;

said outer row of teeth being tapered outwardly from a vertical plane as said outer teeth extend from said lower teeth ends to said upper teeth tips and at least said horizontal base, outer row of teeth and said at least one row of inner teeth being molded in one piece; whereby said outer row of teeth are long enough to lift a sufficient amount of hair to use the device as a pick and said at least one row of inner teeth provides a brushing and teasing element.

2. Improved curling device of claim 1 wherein said teeth and base are made of nylon.

3. Improved curling device of claim 1 wherein said teeth and base are made of heat conducting metal material.

4. Improved curling device of claim 1 wherein said base having a portion of flat surface to act as a stopping element to prevent the device from rolling off from flat surfaces.

5. Improved curling device of claim 1 wherein said teeth, base, and holding element are molded in one piece.

6. Improved curling device of claim 1 wherein said holding element has vertical serrations for easy gripping.

7. Improved curling device of claim 1 wherein said holding element has a heating element.

8. Improved curling device of claim 1 wherein said holding element is a blowdryer.

9. Improved curling device of claim 8 wherein said blowdryer includes an on/off switch, a rotatable electric cord, a temperature control button, and a locking element.

10. Improved curling device of claim 1 wherein said base has multiple openings within the base for air circulation and to prevent shrinkage problems.

11. Improved curling device of claim 1 wherein said holding element is a dispenser for hair styling and curling agent.

12. Improved curling device of claim 1 wherein said holding element can be interchangeable with various sizes and styles of brush heads.

* * * * *